US006313574B1

(12) United States Patent
Banno et al.

(10) Patent No.: US 6,313,574 B1
(45) Date of Patent: Nov. 6, 2001

(54) SHADOW MASK WITH SPECIFICALLY SHAPED APERTURES

(75) Inventors: Tsutomu Banno; Nobumitsu Aibara; Soshi Fukao, all of Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/356,311

(22) Filed: Jul. 16, 1999

(30) Foreign Application Priority Data

Jul. 16, 1998 (JP) ..... 10-201625

(51) Int. Cl.[7] ..... H01J 29/80
(52) U.S. Cl. ..... 313/402; 313/403
(58) Field of Search ..... 313/402, 403

(56) References Cited

U.S. PATENT DOCUMENTS 5,856,725 * 1/1999 Ueda ..... 313/402
6,175,185 * 1/2001 Aibara ..... 313/402

FOREIGN PATENT DOCUMENTS 1-320738 12/1989 (JP) .
5-6741 1/1993 (JP) .

OTHER PUBLICATIONS

SID, EURO Display 1996, p. 138, 11. 1–18.

* cited by examiner

*Primary Examiner*—Vip Patel
(74) *Attorney, Agent, or Firm*—Scully, Scott, Murphy & Presser

(57) ABSTRACT

In a shadow mask type color cathode-ray tube having slot apertures that are straight in the perpendicular direction, the projections of electron beams transmitted by the slot apertures onto the fluorescent screen tend to curve in a banana-like shape with increasing proximity to the right and left sides of the screen, thereby bringing about a drop in the color interference margin and loss margin. The projection of electron beams that are transmitted by the slot apertures and strike the fluorescent screen can be made straight by boring slot apertures in advance that are curved in the direction opposite the curvature of the electron beam projection.

10 Claims, 6 Drawing Sheets

Fig. 8
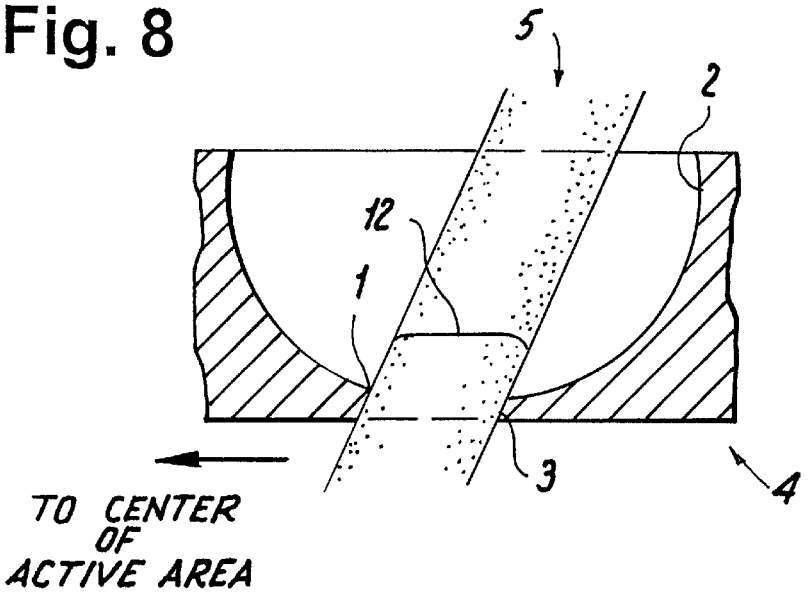
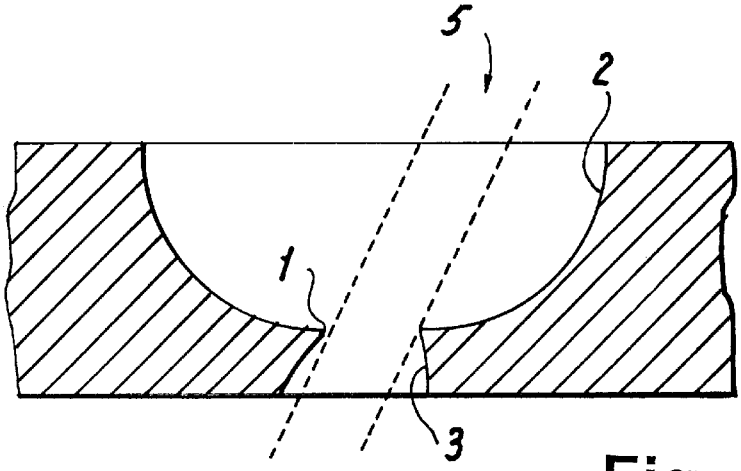
Fig. 9(a)
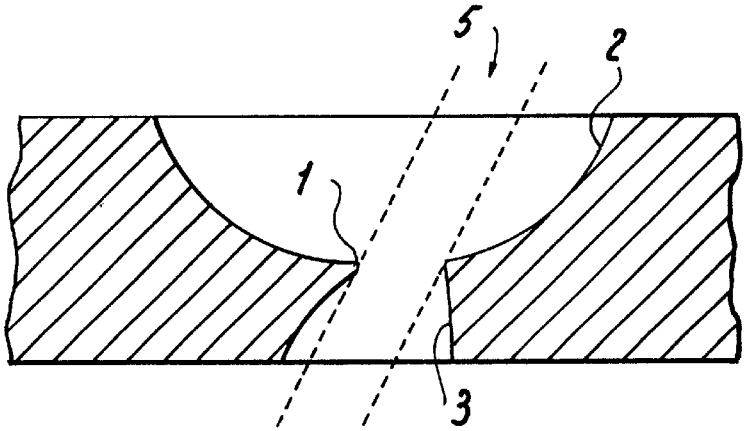
Fig. 9(b)

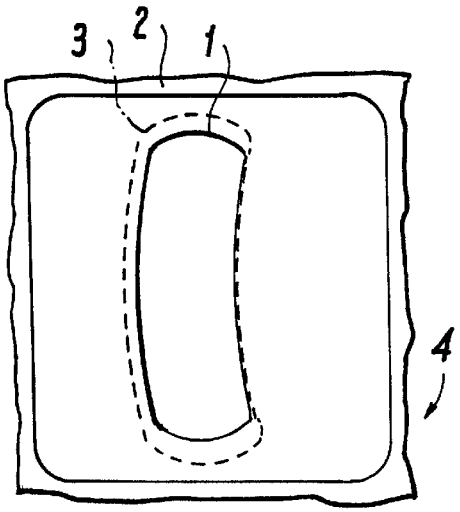
Fig. 12(a)
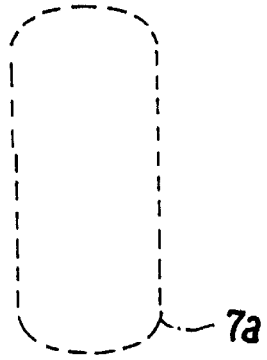
Fig. 12(b)
| Angle of Bending | 0° | 2.5° | 5° | 7.5° | 10° |
|---|---|---|---|---|---|
| Shape of Beam | | | | | |
| Category of Bending | No Bending | Insufficient Bending | Appropriate Bending | Excess Bending | Excess Bending |
Fig. 13(a)
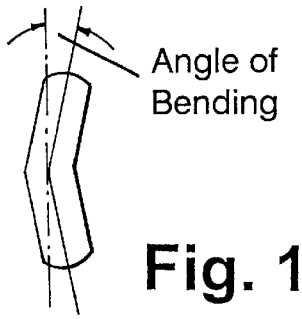
Fig. 13(b)

SHADOW MASK WITH SPECIFICALLY SHAPED APERTURES

BACKGROUND OF THE INVENTION

1. Field of the Invention

The present invention relates to a color cathode-ray tube, and particularly to an improvement of the shape of the slot apertures of a color cathode-ray tube that employs a shadow mask having slot apertures.

2. Description of the Related Art

A shadow mask-type color cathode-ray tube composed of a striped fluorescent screen and a slot-aperture shadow mask is a glass vacuum tube formed from panel and funnel 32, as well as neck tube 33, as shown in FIG. 1. Electron gun 34 is located inside neck tube 33, and three electron beams 5 corresponding to fluorescent stripes of the three colors red, green, and blue are emitted from this electron gun 34. Electron beams 5 are electromagnetically deflected by deflection yoke 36 arranged outside funnel 32 and transmitted through slot apertures of color-selection shadow mask 4. The beams strike the fluorescent stripes of three colors, red, green, and blue, formed on fluorescent screen 8 on the inner surface of panel 31, causing the fluorescent material in the fluorescent stripes to emit light and thus generate an image.

Typically, a combination of a striped fluorescent surface and a slot-aperture shadow mask has been employed in color cathode-ray tubes for television of the prior art, while a combination of a dotted fluorescent surface and a round-aperture shadow mask has been employed in color cathode-ray tubes for high-resolution display. As a standard, the shadow mask of a color cathode-ray tube for television has a horizontal pitch of approximately 0.8 mm and a vertical pitch of approximately 0.8 mm, these values varying somewhat depending on the screen size. In contrast, the pitch of a shadow mask for a high-resolution display has a reference value of approximately 0.27 mm.

Slot-aperture shadow masks are used in color cathode-ray tubes for television chiefly because a brighter image can be obtained than with other types of shadow masks, and because the beam landing margin in the vertical direction is essentially infinite when a slot aperture shadow mask is used in combination with a striped fluorescent surface, thereby simplifying the landing design.

In contrast, round-aperture shadow masks are used in high-resolution display tubes because, in fabricating shadow masks that enable high-resolution display, round-aperture shadow masks are easier to fabricate than slot aperture shadow masks, and because round-aperture shadow masks have a uniform mechanical strength, thereby simplifying the press forming of shadow masks.

However, it has been recently suggested that a striped fluorescent surface is more suitable as the fluorescent screen for high-resolution display tubes than a dot fluorescent surface (for example, SID, EURO Display 1996, p. 138, 11. 1–18). Not only because a striped fluorescent surface is superior for high-resolution, but also due to the greater efforts now being expended toward the development of slot-type high-resolution tubes having striped fluorescent screen as well as due to improvements in shadow mask fabrication technology and shadow mask press formation technology, high-resolution color cathode-ray tubes using slot-type shadow masks are now being fabricated. A standard slot-type shadow mask has a horizontal pitch of approximately 0.25 mm and a vertical pitch of approximately 0.25 mm.

This reduction in pitch, however, has given rise to problems not encountered in color cathode-ray tubes for television. Among these problems, the projection onto fluorescent screen 8 of electron beams bends into electron beam projection 7*b*, which is in an inwardly curving banana-like shape as shown in FIG. 2. This problem is encountered in the case that the electron beam is transmitted by the slot apertures of the shadow mask corresponding to the vicinities of the left and right ends of the display screen. FIG. 2 is an enlarged view of fluorescent screen 8 in the vicinity of the right end of a display screen. The projections of electron beams are actually straight continuously from the upper end to the lower end of fluorescent screen 8 in the order of green fluorescent stripe 9*g* and blue fluorescent stripe 9*b*, but electron beam projection 7*b* corresponding to slot apertures in the vicinities of both the right and left ends of the display screen is bent approximately 10 $\mu$m in a banana-like shape.

If the electron beam projection is adjusted to achieve just landing of the central portion of the electron beam projection onto the fluorescent stripe, the upper and lower end areas of inwardly bending electron beam projection 7*b* will be shifted toward the center (inwardly) with respect to straight electron beam projection 7*a* as shown in FIG. 3. In addition, inner portions 11 at the upper end and lower end of electron beam projection 7*b* approach the adjacent stripe on the inward side and thus tend to strike the stripe of another color, resulting in color interference. Moreover, outward portions 12 (in the direction opposite the center when viewed in the horizontal direction of the screen) at the upper and lower portions of electron beam projection 7*b* deviate from the fluorescent stripe and therefore tend to give rise to areas of diminished light emission. This phenomenon was not recognized as a problem in color cathode-ray tubes for television.

To examine this phenomenon using actual numerical values, in a 17-inch high-resolution tube in which the shadow mask has a horizontal pitch of 0.25 mm, the width of the fluorescent stripes is approximately 42 $\mu$m, the width of the graphite stripes is approximately 45 $\mu$m, and the width of an electron beam projection is approximately 75 $\mu$m. Even in cases in which the electron beam projection is straight and free of bending, a drop in luminance begins with a mislanding of 17 $\mu$m with respect to a stripe of 42 $\mu$m, and color interference (impingement on stripes of other colors) begins with a mislanding of 29 $\mu$m. Accordingly, the banana-like bending of 10 $\mu$m described above causes the landing margin to be reduce by 10 $\mu$m, thereby causing color interference to occur, i.e., another color to be hit, with a mislanding of only 19 $\mu$m.

A bend of approximately 10 $\mu$m in the projection of an electron beam is consequently a considerably large value for luminance and landing margin in the case of a high-resolution tube, and the correction of this bending is extremely important for the production of a slot-type high-resolution tube.

Japanese Patent Laid-open No. 320738/89 relates to a color cathode-ray tube for television. The document points out the problem that, when the plate thickness of the shadow mask is increased in order to meet such requirements as larger size and wider deflection angle, the projection onto the fluorescent screen of the electron beams blocked by the inner wall of the slot transmission apertures becomes seed-shaped as a persimmon seed.

One method that has been proposed to solve this problem involves partially widening the slot apertures by retreating only the outer side-surface of the aperture in the outward direction of the screen, as shown in FIG. 4, so as to prevent the electron beam projection from being deformed by collision with the outer side-surface.

Japanese Patent Laid-open No. 6741/93 describes the blocking of the electron beam by the corner areas of the siedewalls of slot apertures as one cause for the deformation of a beam projection. To prevent this deformation and improve the beam form, the corners of slot transmission aperture 1 and front-side large aperture 2 are extended outward in the horizontal direction as shown in FIG. 5.

The problems disclosed in the above-described documents are similar to the previously described banana-shaped deformation in that the problems relate to the shape of the projection of an electron beam that is transmitted by a slot aperture of a shadow mask. However, the thickness of the shadow mask of the cited color cathode-ray tubes for television is relatively thick, from 0.15 to 0.18 mm or from 0.2 to 0.3 mm, and the persimmon-seed-shaped deformation of the electron beam projection differs from the above-described banana-shaped deformation in that it is generated when a portion of the electron beam strikes the sidewall surrounding the front-side large apertures of a thick shadow mask, as described below.

It is believed that the use of a thin shadow mask, measuring from 0.1 mm to 0.13 mm thick, in a high-resolution color cathode-ray tube greatly suppresses the persimmon-seed-shaped deformation. As will be explained hereinbelow, the banana-shaped deformation is caused because the minimum-width portions of a slot transmission aperture are not in the same plane, the positions of the upper and lower ends of the slot transmission aperture being at positions 30 $\mu$m closer to the panel than the vertical center of the aperture, and because the incidence of the electron beam is more inclined in the horizontal direction at the two horizontal extremities of the shadow mask than at the middle thereof.

The banana-lice curvature of the electron beam projection in a high-resolution color cathode-ray tube occurs because the minimum-width portion of the slot transmission aperture, which actually determines the shape of beam projection, is not in the same plane, the minimum-width portion at the short sides of the slot transmission aperture being approximately 30 $\mu$m closer to the inner surface of the panel than the minimum-width portion at the center of the long sides. As a result, of the electron beams diagonally incident on the slot transmission aperture, the electron beam that is transmitted by the portion of the slot aperture in the areas of the short sides (the portion closest to the panel) lands at a more inward point in the horizontal direction of the display screen than an electron beam that is transmitted by the central portion of the slot aperture, which is relatively far from the inner surface of the panel. An electron beam that is transmitted by the center of the long sides of a slot thus lands at a more outward point than a beam transmitted by the short sides. As a result, the projection of an electron beam takes on a banana-like shape in which the upper and lower ends are bent inwardly in the horizontal direction.

The banana-shaped bend of an electron beam projection in a high-resolution color cathode-ray tube is therefore not caused by the blocking of an electron beam by the wall around the slot aperture on the front side of the aperture, and as a result, both the cause and the problem of banana-shaped curvature of the projection of an electron beam transmitted by an aperture differ from the case of a color cathode-ray tube for television.

Lowering the positions of the minimum-width portions of the short sides of the slot apertures to the same height as those of the long sides can be considered as a countermeasure to this bending, but such a countermeasure would also entail an unacceptable loss in luminance due to widening of the bridge portions. Conversely, raising the position of the minimum width portions of the long sides to the same height as the position of the minimum-width portion of the short sides can also be considered, but this course would entail increased beam reflection from the inclined sidewall surfaces of the rear-side small aperture toward the fluorescent screen, thereby causing an undesirable reduction in contrast.

The problem to be solved by the present invention can therefore be summarized as follows:

The minimum-width portion of a slot transmission aperture of a shadow-mask slot aperture does not all lie in the same plane, the position of the minimum-width portion of the slot curving to approach the panel as the short-sides are approached from the center of the long sides. As a result, the projection onto the inner surface of the panel, of an electron beam that is transmitted by a slot aperture located in the vicinity of the right end on the horizontal axis of the active area of a shadow mask becomes electron beam projection 7*b*, in which the upper and lower ends bend toward the left with respect to the vertical center of the projection, as shown in FIG. 6. The electron beam projection therefore takes on a bent banana-like shape.

In the case of a 17-inch 90-degree deflection tube, the upper and lower ends of an electron beam projection shift by approximately 10 $\mu$m to the left, and therefore tend to strike the adjacent stripe to the left. Landing margin therefore decreases and color interference occurs, thereby giving rise to the problem of the increased potential for a loss in color saturation. At the same time, the leftward shift of the electron beam projection in the vicinity of the upper and lower ends of the electron beam projection causes the beam to tend to miss on the right side of the target stripe, thereby giving rise to the problem of an increased potential for a drop in luminance and a loss in white uniformity. A decrease of 10 $\mu$m in margin was negligible for a color cathode-ray tube for television in which the margin is great, but such a decrease is a problem that cannot be ignored in a high-resolution color cathode-ray tube in which the margin is small.

SUMMARY OF THE INVENTION

It is an object of the present invention to provide a high-resolution color cathode-ray tube that corrects the banana-shaped curvature of the projection of an electron beam transmitted by the slot apertures of a shadow mask to arrive on the fluorescent screen, and that, by straightening the electron beam projection, increases the color interference margin and loss margin and maintains stable color saturation and white uniformity.

To solve the above-described problems of the prior art, the shadow-mask type color cathode-ray tube of the present invention includes a shadow mask having a slot transmission aperture which defines a surface curving toward the front or rear side with respect to a prescribed reference plane, and is shaped such that the position of each portion of said aperture is shifted in the lateral direction of the slot transmission aperture depending on a longitudinal position of the portion so as to compensate for deviation in the position of the projection of an electron beam onto a fluorescent screen from a designed position on the screen, the deviation being caused by the curvature of said surface.

It can be presumed without generality that the slot aperture has two long sides facing to each other and two short sides facing each other. Under this presumption, the shape of the slot transmission aperture can be bent such that a lateral position of a point on the long side of the slot transmission aperture is shifted outwardly in the lateral direction with respect to the lateral position of the center of the long side with increasing distance from the center of the long side. The term "outward" refers to the orientation to an end portion of the active area in the shadow mask in the lateral direction.

The curved shape of the slot transmission aperture may be a circular arc having its center of curvature outward of the slot transmission aperture in the lateral direction A slot transmission aperture may extend linearly from the centers of the long sides of the slot transmission aperture in a direction making an angle of bending with the longitudinal direction, the angle of bending being determined so as to compensate for deviation in the position of the projection of an electron beam onto a fluorescent screen from a designed position on the screen caused by the curvature of said surface of the slot transmission aperture, and the longitudinal direction referring to the direction perpendicular to the lateral direction. The angle of bending refers to an angle formed by the longitudinal direction and a line that joins the center of that slot transmission aperture and the short side.

The outward bending in the lateral direction of the long sides of a slot transmission aperture may increase with increasing outward distance of the position of that slot transmission aperture from the center of the active area in the lateral direction.

Simulation may be carried out with the assumption that the length of the outward shift in the lateral direction of each point on the long sides of the slot transmission aperture increases in proportion to the second power or fourth power of the eccentric distance in the lateral direction from the center of the active area to that slot transmission aperture.

In a 90° diagonal deflection color cathode-ray tube, the angle of bending can be determined such that, for a slot transmission aperture located at a lateral extremity of the active area, is approximately 6 degrees, and is within a practical permissible range of 4–9 degrees.

In a 100° diagonal deflection color cathode-ray tube, the angle of bending can be determined such that, for a slot transmission aperture located at a lateral extremity of the active area, the angle of bending is approximately 8 degrees, and is within a practical permissible range of 6–11 degrees.

The curvature of the projection of electron beams can thus be compensated by bending in advance the shape of a slot aperture in the direction opposite the curvature of the electron beam projection.

The above and other objects, features, and advantages of the present invention will become apparent from the following description referring to the accompanying drawings which illustrate examples of preferred embodiments of the present invention.

BRIEF DESCRIPTION OF THE DRAWINGS

FIG. 8 is a sectional view along line 8—8of FIG. 7;

FIG. 9(*a*) shows the relation between positions of the edge of a slot transmission aperture and the direction of an electron beam at the plane of intersection of the 8—8 plane of FIG. 7 and a slot transmission aperture;

FIG. 9(*b*) shows the relation between positions of the edge of a slot transmission aperture and the direction of an electron beam at the plane of intersection of the vicinity of the end of a slot and a plane parallel to the 8—8 plane;

FIG. 12(*a*) shows a curved slot aperture of the invention and an electron beam projection that has been straightened as a result of using the bent slot; and FIG. 12*b* shows an electron beam projection that has been straightened as a result of using the bent slot;

FIG. 13(*a*) shows an example of the evaluation of the shape of electron beams corresponding to various angles of bending; and FIG. 13(*b*) illustrates where the various angles of bending are measured.

DETAILED DESCRIPTION OF THE PREFERRED EMBODIMENTS

An embodiment of the invention is next described with reference to the accompanying drawings.

This embodiment relates to a color cathode-ray tube that employs a slot-type shadow mask in which substantially rectangular slot apertures are linked in the vertical direction by way of bridge portions to form a column of slots, a plurality of these columns of slots being aligned in the lateral direction to form an active area.

The shape of the transmission aperture of a shadow mask is defined as the reference shape when the shape of the shadow-mask slot transmission aperture is a rectangle; the vertical axis is defined as a line that lies in the plane containing a transmission aperture of reference shape and that is equidistant from the two long sides of the transmission aperture, which has its longitudinal direction directed in the vertical direction; and the horizontal axis or lateral axis is defined as a line that is in the plane containing a transmission aperture of the reference shape, that is equidistant from the two short sides, and that is perpendicular to the vertical axis. The intersection of the vertical axis and horizontal axis is defined as the center of the transmission aperture. The points at which the long sides intersect with the horizontal axis are defined as the centers of the long sides, the side of the transmission aperture that exits electron beams is defined as the front side, the side upon which electron beams are incident is defined as the rear side, and the direction of the active area in which the angle of incidence of electron beams increases is defined as the outward direction. The electron gun lies on the center line of the active area.

Figure 1:
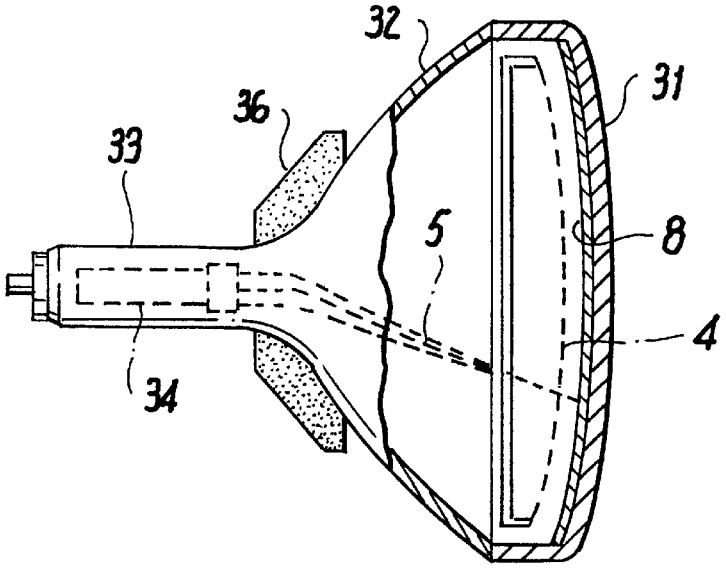
Fig. 1 (Prior Art)
FIG. 1 is a sectional view showing the construction of a shadow-mask type color cathode-ray tube.
Figure 2:
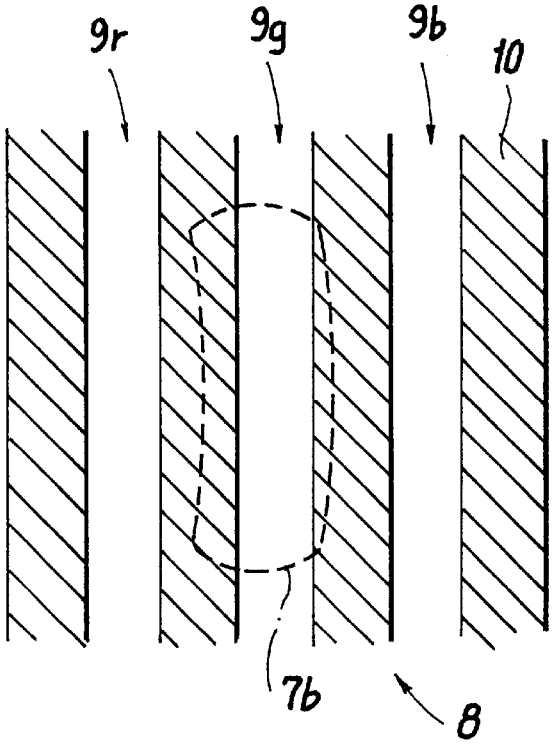
Fig. 2 (Prior Art)
FIG. 2 shows the bend of an electron beam projection onto straight fluorescent stripes.
Figure 3:
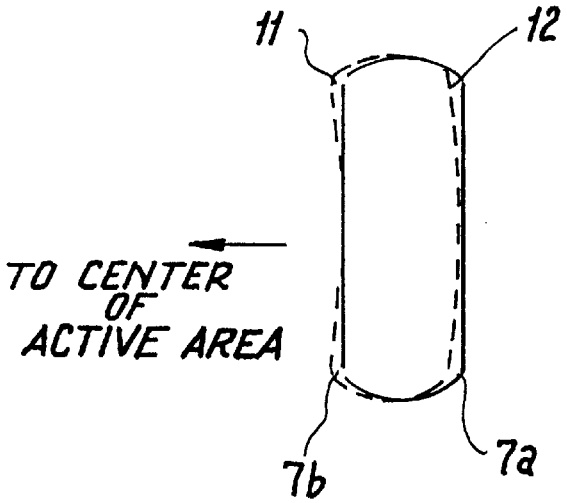
Fig. 3 (Prior Art)
FIG. 3 is an explanatory view showing the part of the bent electron beam that tends to cause color interference and the part that tends to be lost.
Figure 4:
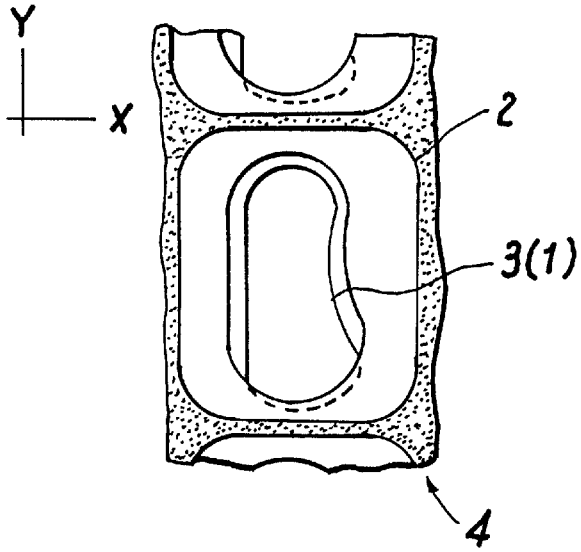
Fig. 4 (Prior Art)
FIG. 4 shows an example of the prior art that is close to the present invention.
Figure 5:
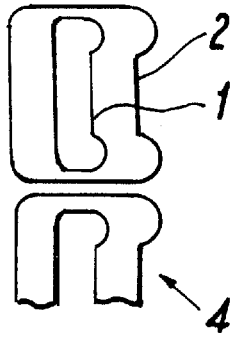
Fig. 5 (Prior Art)
FIG. 5 shows an example of the prior art having content close to that of the present invention.
Figure 6A:
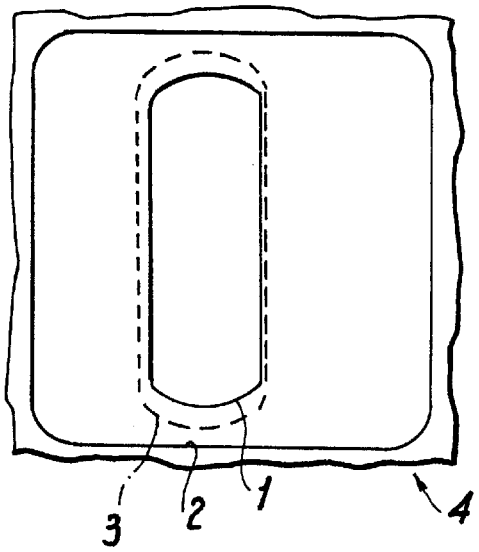
Fig. 6(a) (Prior Art)
FIG. 6*a* is an explanatory view showing a straight slot transmission aperture of the Prior Art.
Figure 6B:
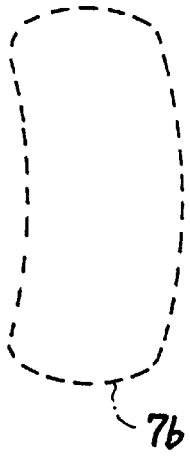
Fig. 6(b) (Prior Art)
FIG. 6*b* is a illustration of an electron beam projected through a straight slot aperture at a horizontal end portion of a Prior Art screen.
Figure 7:
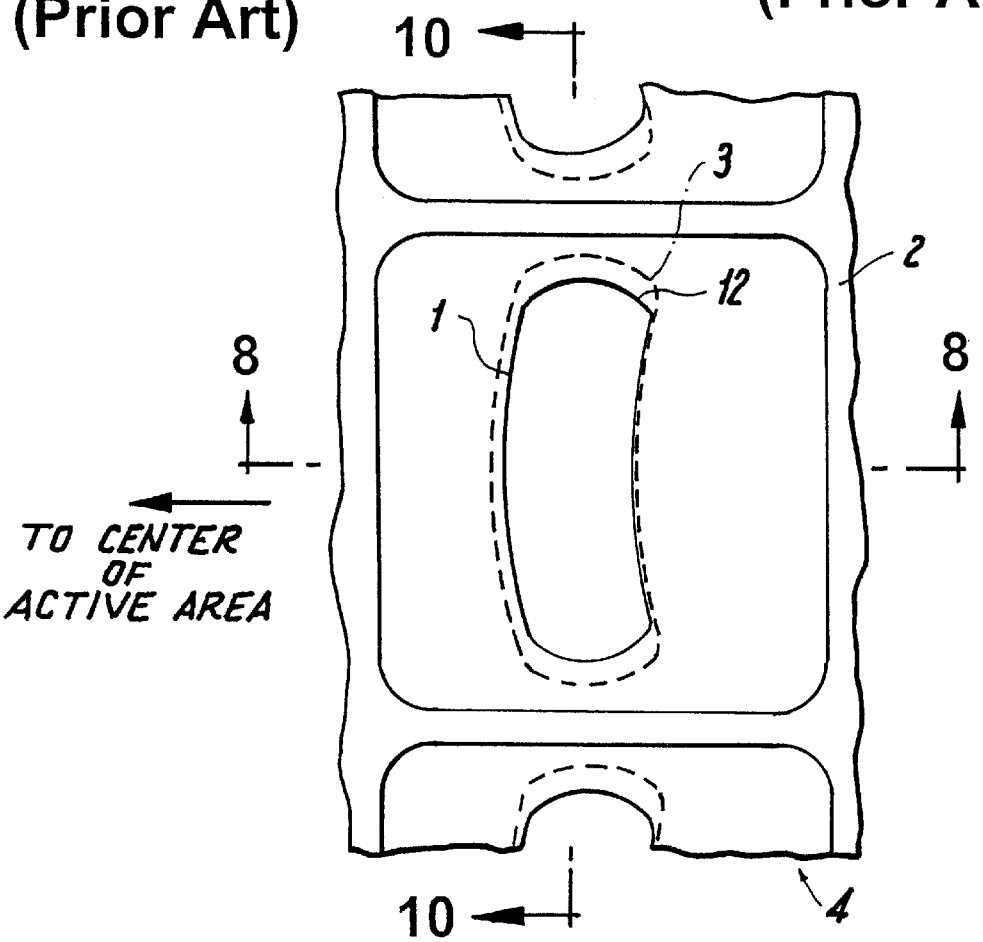
FIG. 7 is an enlarged plan view of a slot aperture for showing the curvature of a shadow mask slot aperture in an embodiment of the present invention.

FIG. 7 is a plan view showing an embodiment of the present invention.

FIG. 7 is a plan view showing the shape of a slot aperture in the vicinity of the right end in the horizontal direction of the active area in a shadow mask. Slot transmission aperture 1 is formed by connecting front hole 2, which is formed by etching from the panel side of the shadow mask (front side), with rear hole 3, which is formed by etching from the electron-gun side (rear side). The portion at which front hole 2 joins with rear hole 3 is the minimum-width portion (transmission aperture 1) of the slot. The front hole is normally etched deeper than the rear hole, and as a result, not only are the dimensions of the front hole greater than the dimensions of the rear hole, but the minimum-width portion is formed at a position closer to the electron-gun side than the center in the direction of thickness of the shadow mask. In order for the upper-end portion or lower-end portion of the slot to form a bridge portion with a neighboring slot in the vertical direction, the depth of etching of the front hole is gradually decreased while the depth of etching of the rear hole increased to connect with the bridge portion. As a result, transmission aperture 1 gradually rises to approach the panel side from the central portion of the slot toward both the upper end portion and lower end portion, as described hereinabove. In this way, the slot transmission aperture defines a curved surface. An electron beam passes through this transmission aperture 1, strikes the fluorescent stripes on the inner surface of the panel, and brings about the emission of light. As shown in FIG. 7, slot transmission aperture 1 of this invention is a circular arc that is open to the right with respect to the center of the aperture, i.e., that has a center of curvature lying on the right side of the aperture.

FIG. 8 shows both the sectional plane A—A that contains the horizontal axis of the slot aperture of the shadow mask of FIG. 7 and the direction of incidence of electron beam 5.

Front large-hole portion 2 that is etched from the panel side and rear small-hole portion 3 that is etched from the electron-gun side meet to form slot transmission aperture 1. The local position of slot transmission aperture 1 rises more toward the panel side (upward in FIG. 8) while shifting in the horizontal direction along the direction of the obliquely incident electron beam, as the position is closer to short sides 12 (refer to reference numeral 12 in FIG. 7). Accordingly, the slot transmission aperture 1 forms the highest points (reference numeral 12 in FIG. 8 ), i.e., the closest points to the panel, at the short-side end portions 12, while forming the lowest points (the most distant points from the panel) at the centers of the long sides of the slot transmission aperture (the position of intersection between sectional plan A—A of FIG. 8 and the slot transmission aperture).

It is to be noted that, since the parts of the slot transmission aperture shift along the direction of incidence of the electron beam, the electron beams that transmit through individual sections of the slot transmission aperture impinge on the panel at the same horizontal position to create a straight projection.

FIG. 9(*a*) is an explanatory view showing the relation between slot transmission aperture 1 and the direction of incidence of the electron beam at the section of 8—8 of FIG. 7.

FIG. 9(*b*) a section in which the slot is cut by a plane that is parallel to section 8—8 and at a position close to the end surface of the slot. As can be seen from the figure, the position of slot transmission aperture 1 shifts in a horizontal direction while rising in the upward direction in the figure (the direction approaching the panel) with progression along the direction of the electron beam from a position in the central portion of the slot to a position in an end portion.

Figure 10:
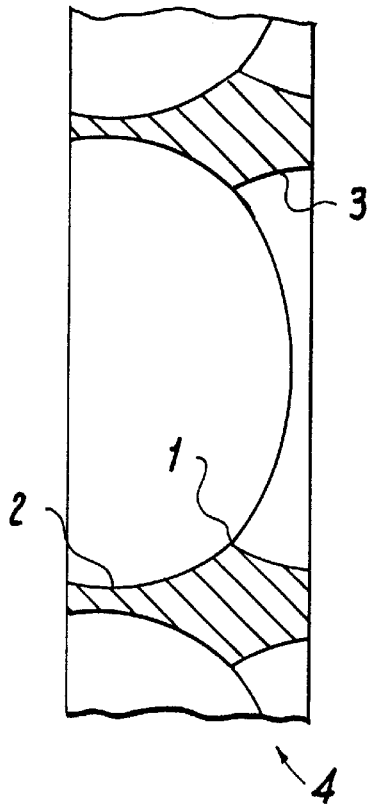
FIG. 10 is a sectional view along 10—10 of FIG. 7.

FIG. 10 shows section 10—10 that contains the vertical axis of the shadow mask slot aperture of FIG. 7, and shows that slot transmission aperture 1 rises toward the panel side as the short sides are approached from the center of the long sides.

Forming shadow-mask slot aperture in the shape shown in FIGS. 7–10 causes the direction of rising of the slot transmission aperture to coincide with the direction of incidence of electron beam 5, as shown in FIG. 8, FIG. 9*a* , and FIG. 9*b* for a shadow-mask, slot located in the vicinity of the right end in the horizontal direction of a display screen. As a result, an electron beam projection formed on the inner surface of the panel is rendered as straight projection 7*a* as shown in FIG. 12*b* instead of the banana-shaped curve of projection 7*b* that occurred in the slot transmission aperture of the prior art.

There is, of course, no need for bending of slot transmission aperture 1 shown in FIG. 7 in the center of the display screen, but the bending of slot transmission aperture 1 is gradually increased as the end portions are approached in a horizontal direction from the center of the screen and the angle of incidence of the electron beam increases. This bend is necessary because, as should be obvious from FIGS. 9*a* and 9*b*, the position of slot transmission aperture 1 must be greatly displaced in the horizontal direction along the direction of the electron beam if the inclination of the electron beam is large.

If X is the eccentric distance in the horizontal direction from the center of the active area to the point of incidence of the electron beam on the shadow mask, the degree of increase in the bend of the slot is preferably expressed as a function of the second or fourth power of X, because the inclination of the electron beam is symmetrical Lo the left and right of the screen.

In practical terms, a sufficient approximation can be obtained when simulation is carried out expressing the amount of bending in this way, and bend of electron beam projections can thus be solved over the entire screen.

Figure 11:
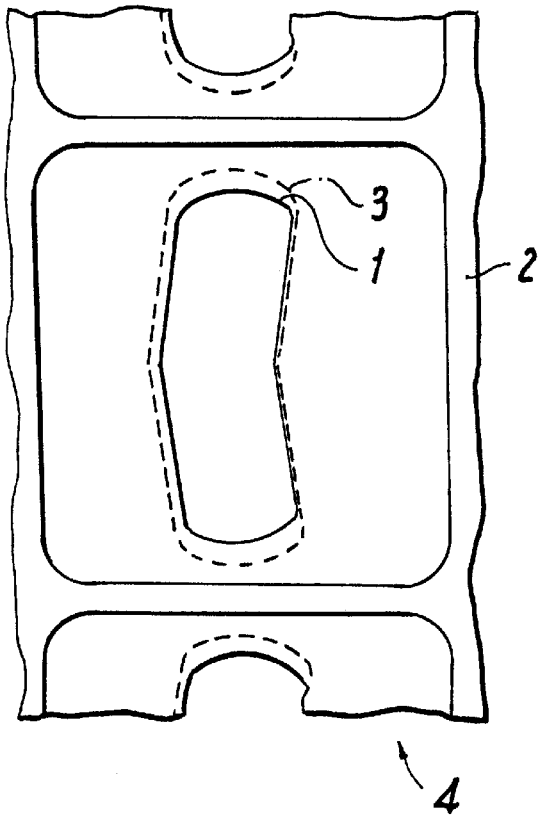
FIG. 11 is an enlarged plan view showing the second embodiment of the present invention.

FIG. 11 shows the second embodiment. Making the shape of a shadow mask slot transmission aperture a simple bent line in a "<" shape is sufficiently effective in practical terms. The projection of the electron beam is made essentially straight by adopting an appropriate angle of bending. In fabricating a shadow mask, forming the slot transmission aperture as a bent line is easier and more practical than forming it as a circular arc.

In more concrete terms, in a 17-inch 90° diagonal deflection high-resolution display having a shadow mask with substantially rectangular slot transmission apertures having the dimensions of 180 $\mu$m×60 $\mu$m, the projection of electron beams through slot transmission apertures in the vicinities of the right and left ends in the horizontal direction of the screen is somewhat magnified to the order of 190 $\mu$m×75 $\mu$m. In this case, a measurement of the amount of shift in the horizontal direction at a point vertically separated from the vertical center by 60 $\mu$m, i.e., a measurement of the amount of bending, yields approximately 6 $\mu$m, and has an inclination of approximately 6° with respect to the vertical axis.

To correct this to a straight line, shadow-mask slot transmission apertures are prepared having a bent "<" shape with lines inclined toward the outside of the screen 2.5°, 5°, 7.5°, and 10° with respect to the vertical axis, color cathode-ray tubes employing these shadow masks are produced on an experimental basis, and the bend of electron beam projections for the corners and vicinities of the right and left ends of the screen are compared (FIG. 13*a*). In FIG. 13*a*, the shape of the electron beams corresponding to the various angles of bending are rated by the categories: "no bending," "insufficient bending," "substantially appropriate bending," "excessive bending," and "excessive bending." The results show that, while some correction is still required, the bend of an electron beam projection is smallest with an angle of bending of 5°. With further experimentation, it was found that the optimum bending of the slot aperture is 6°, and the practical permissible range was determined to be 4–9°.

The results of similar experimentation with a 17-inch 100° diagonal deflection tube showed that the optimum angle of bending of the slot aperture was 8° with a practical permissible range of 6–11°.

As explained hereinabove, the shape of the projection of an electron beam on the fluorescent screen of the inner surface of the panel can be made straight in a shadow-mask type color cathode-ray tube according to the present invention by progressively shifting the shape of the shadow-mask slot transmission aperture in the outward direction of the active area as the position on the long side of the transmission aperture becomes more distant from the vertical center of the slot transmission aperture.

The present invention allows an increase in the color interference margin for adjacent fluorescent stripes, an increase in the color saturation margin, and in addition, an increase in the loss margin for maintaining white uniformity. The three colors red, green, and blue can therefore be obtained with stable color saturation, and stable white uniformity can also be obtained.

It is to be understood, however, that although the characteristics and advantages of the present invention have been set forth in the foregoing description, the disclosure is illustrative only, and changes may be made in the shape, size, and arrangement of the parts within the scope of the appended claims.

What is claimed is:

1. A color cathode-ray tube using a slot-type shadow mask in which a column of slots is constructed by linking approximately rectangular slot apertures in a direction parallel to the longitudinal direction of the slot by way of bridge portions, a plurality of said column of slots are lined up in the direction parallel to a lateral direction of the slot to form an active area;

wherein a shape of a slot transmission aperture of said shadow mask is defined as the reference shape when the shape of the slot transmission aperture is rectangular; a longitudinal axis is defined as a line that lies within a plane containing a slot transmission aperture of reference shape and that is equidistant from two long sides of said slot transmission aperture; a lateral axis is defined as a line that lines within the plane containing said slot transmission aperture of reference shape, that is equidistant from two short sides, and that is perpendicular to the longitudinal axis; an intersection of said longitudinal axis and lateral axis is defined as a center of that slot transmission aperture; the direction parallel to said lateral axis is defined as a lateral direction; points of intersection of said long sides and said lateral axis are defined as the centers of the long sides; a side of said slot transmission aperture from which an electron beam exits is defined as the front side and the side into which an electron beam is incident is defined as the rear side; and the direction in which an angle of incidence of an electron beam on said active area increases is defined as outward;

said shadow-mask type color cathode-ray tube including a shadow mask having a slot transmission aperture which defines a surface curving toward the front or rear side with respect to a prescribed reference plane, and has a bend in shape such that a position of each portion of said aperture is shifted in the lateral direction of said slot transmission aperture depending on a longitudinal position of the portion so as to compensate for deviation in the position of a projection of an electron beam onto a fluorescent screen from a designed position on the screen, said deviation being caused by a curvature of said surface.

2. A color cathode-ray tube according to claim 1 wherein the shape of said slot transmission aperture is bent such that a lateral position of a point on the long side of said slot transmission aperture is displaced outwardly in the lateral direction with respect to the lateral position of the center of said long side with increasing distance from said center of the long side.

3. A color cathode-ray tube according to claim 2 wherein the bent shape of said slot transmission aperture is a circular arc having its center of curvature outward in the lateral direction.

4. A color cathode-ray tube according to claim 2 wherein said slot transmission aperture extends linearly from the centers of the long sides of said slot transmission aperture in a direction making an angle of bending with said longitudinal direction, the angle of bending being an angle that a long-side segment extending from the center of the long side makes with the longitudinal direction and determined so as to compensate for said deviation in the position of the projection of an electron beam caused by the curvature of said surface.

5. A color cathode-ray tube according to claim 1 wherein the bend in the shape of said slot transmission aperture increases with increasing outward distance in the lateral direction of the position of that slot transmission aperture from the center of said active area.

6. A color cathode-ray tube according to claim 2 wherein the amount of outward displacement in the lateral direction of each point on the long sides of said slot transmission aperture increases in proportion to the second power or fourth power of the eccentric distance in the lateral direction from the center of said active area to that slot transmission aperture.

7. A color cathode-ray tube according to claim 2 wherein said color cathode-ray tube is a 90° diagonal deflection type, and wherein the amount of outward displacement in the lateral direction of each point on the long sides of said slot transmission aperture is determined such that, for a slot transmission aperture located in an end portion in the lateral direction of the active area, the angle formed by the longitudinal axis of said slot transmission aperture and a line that joins said short side and said center of said slot transmission aperture is approximately 6 degrees.

8. A color cathode-ray tube according to claim 7 wherein said angle is 4–9 degrees.

9. A color cathode-ray tube according to claim 2 wherein said color cathode-ray tube is a 100° diagonal deflection type, and wherein the amount of outward displacement in the lateral direction of each point on the long sides of said slot transmission aperture is determined such that, for a slot transmission aperture located in an end portion in the lateral direction of the active area, the angle formed by the longitudinal axis of said slot transmission aperture and a line that joins said short side and the center of said slot transmission aperture is approximately 8 degrees.

10. A color cathode-ray tube according to claim 9 wherein said angle is 6–11 degrees.

* * * * *